US011778389B2

(12) United States Patent
Kobayashi

(10) Patent No.: US 11,778,389 B2
(45) Date of Patent: Oct. 3, 2023

(54) LOUDSPEAKER DEVICE

(71) Applicant: Panasonic Intellectual Property Management Co., Ltd., Osaka (JP)

(72) Inventor: Yuki Kobayashi, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/700,100

(22) Filed: Mar. 21, 2022

(65) Prior Publication Data

US 2022/0312125 A1 Sep. 29, 2022

(30) Foreign Application Priority Data

Mar. 26, 2021 (JP) ..... 2021-053421

(51) Int. Cl.

| | |
|---|---|
| ***H04R 9/06*** | (2006.01) |
| ***H04R 7/12*** | (2006.01) |
| ***H04R 9/02*** | (2006.01) |
| ***H04R 9/04*** | (2006.01) |
| ***H04R 7/18*** | (2006.01) |

(52) U.S. Cl.

CPC ..... *H04R 9/06* (2013.01); *H04R 7/12* (2013.01); *H04R 7/18* (2013.01); *H04R 9/025* (2013.01); *H04R 9/04* (2013.01); *H04R 2400/11* (2013.01)

(58) Field of Classification Search

CPC ... H04R 9/06; H04R 7/12; H04R 7/18; H04R 9/025; H04R 9/04; H04R 2400/11

See application file for complete search history.

(56) References Cited

U.S. PATENT DOCUMENTS

2009/0052725 A1* 2/2009 Oda ..... H04R 9/06 381/386

FOREIGN PATENT DOCUMENTS

CN 112383853 A * 2/2021 ..... H04R 1/02
JP 2006-186517 7/2006

* cited by examiner

*Primary Examiner* — Sunita Joshi
(74) *Attorney, Agent, or Firm* — GREENBLUM & BERNSTEIN, P.L.C.

(57) ABSTRACT

A loudspeaker device includes: a magnetic circuit that includes a yoke, a magnet, and a top plate; a voice coil body; a diaphragm; and a frame that holds the yoke and the diaphragm. The frame includes a through hole that holds the yoke at a predetermined position with the yoke being inserted into the through hole. The yoke includes a protrusion portion that abuts an outer peripheral surface portion of the frame that defines the through hole, with the magnetic gap being inside the frame.

3 Claims, 5 Drawing Sheets

LOUDSPEAKER DEVICE

CROSS REFERENCE TO RELATED APPLICATION

The present application is based on and claims priority of Japanese Patent Application No. 2021-053421 filed on Mar. 26, 2021.

FIELD

The present disclosure relates to a loudspeaker device that converts an electric signal into sound.

BACKGROUND

Conventionally, there are loudspeaker devices such as the loudspeaker device disclosed in Patent Literature (PTL) 1 in which a yoke having a cylindrical shape with a bottom forms a magnetic circuit. The yoke includes a protrusion that protrudes outwardly to an opening end of the yoke. The yoke is fixed to a frame, which may be referred to as a base component, when the protrusion is engaged in an engagement portion provided to the frame.

CITATION LIST

Patent Literature

PTL 1: Japanese Unexamined Patent Application Publication No. 2006-186517

SUMMARY

However, the loudspeaker device disclosed in the above-described PTL 1 can be improved upon.

In view of this, the present disclosure provides a loudspeaker device capable of improving upon the above related art.

In order to achieve the above, a loudspeaker device according to one aspect of the present disclosure includes: a magnetic circuit that includes a yoke having a cylindrical shape with a bottom; a magnet; and a top plate; a voice coil body including one end portion inserted into a magnetic gap between the yoke and the top plate; a diaphragm connected to another end portion of the voice coil body; and a frame that holds the yoke and the diaphragm. The frame includes a through hole that holds the yoke at a predetermined position with the yoke being inserted into the through hole, and the yoke includes a protrusion portion that abuts an outer peripheral surface portion of the frame that defines the through hole, with the magnetic gap being inside the frame.

The loudspeaker device according to one aspect of the present disclosure is capable of improving upon the above related art.

BRIEF DESCRIPTION OF DRAWINGS

These and other advantages and features of the present disclosure will become apparent from the following description thereof taken in conjunction with the accompanying drawings that illustrate a specific embodiment of the present disclosure.

DESCRIPTION OF EMBODIMENT

Hereinafter, an embodiment of a loudspeaker device according to one aspect of the present disclosure will be described with reference to the drawings. It should be noted that the embodiment described below merely shows one or more examples of the present disclosure to describe the present disclosure, and therefore not intended to limit the present disclosure. For example, the shapes, structures, materials, structural components, relative positional relations, connection, numerical values, mathematical expressions, content of each step of methods, the order of the steps, and so on, described in the following embodiment are mere examples, and therefore may include contents not described below. Moreover, geometrical terms, such as "parallel" and "perpendicular" may be used, but these expressions are not intended to describe the present disclosure in mathematically strict terms and may include some tolerances and substantially allowable differences. Moreover, expressions such as "at the same time" and "same" may also include some tolerances.

In addition, each of the drawings is a schematic diagram including emphasis, omission, and/or adjustment of ratios as appropriate to describe the present disclosure. The shapes, positional relations, and ratios may differ from the actual shapes, positional relations, and ratios.

Moreover, a plurality of aspects of the present disclosure may be described as one general embodiment below. Moreover, part of the description below are described as optional structural components related to the present disclosure.

Figure 1:
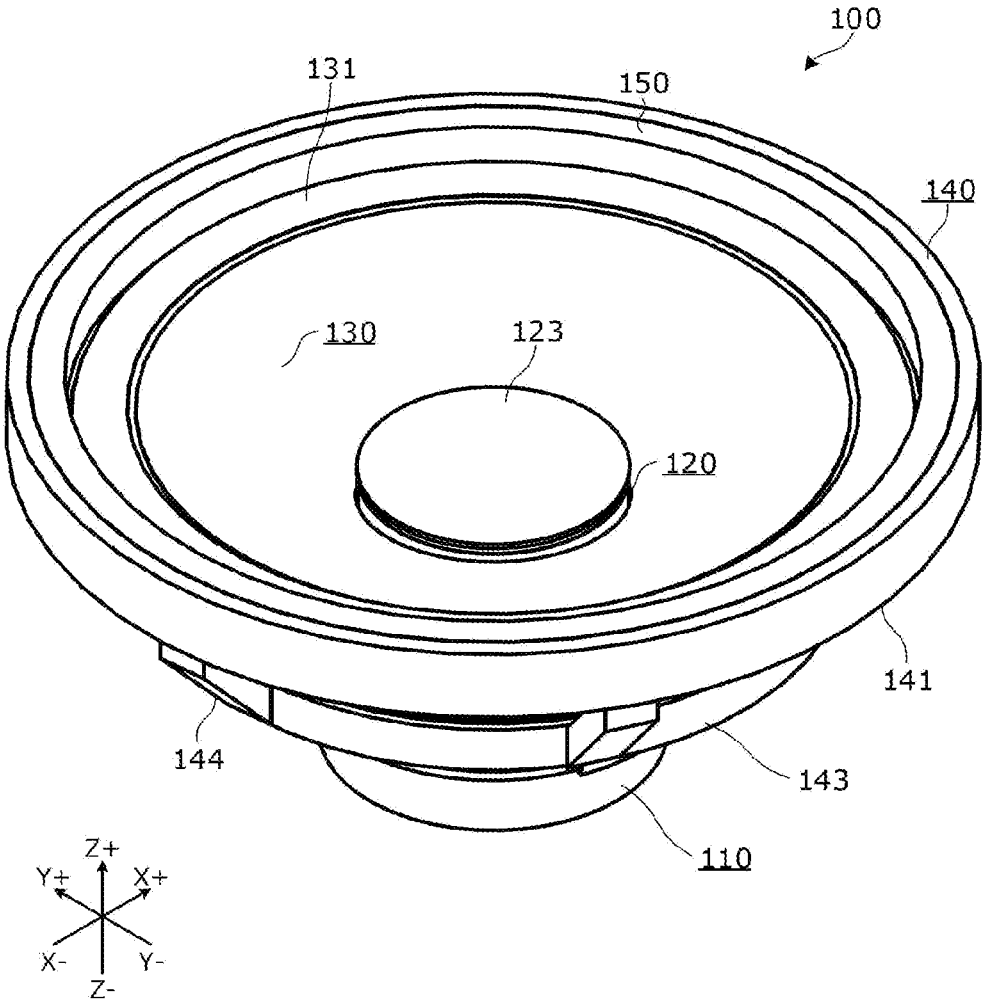
FIG. 1 is a front perspective view of an external appearance of a loudspeaker device according to the present embodiment.
Figure 2:
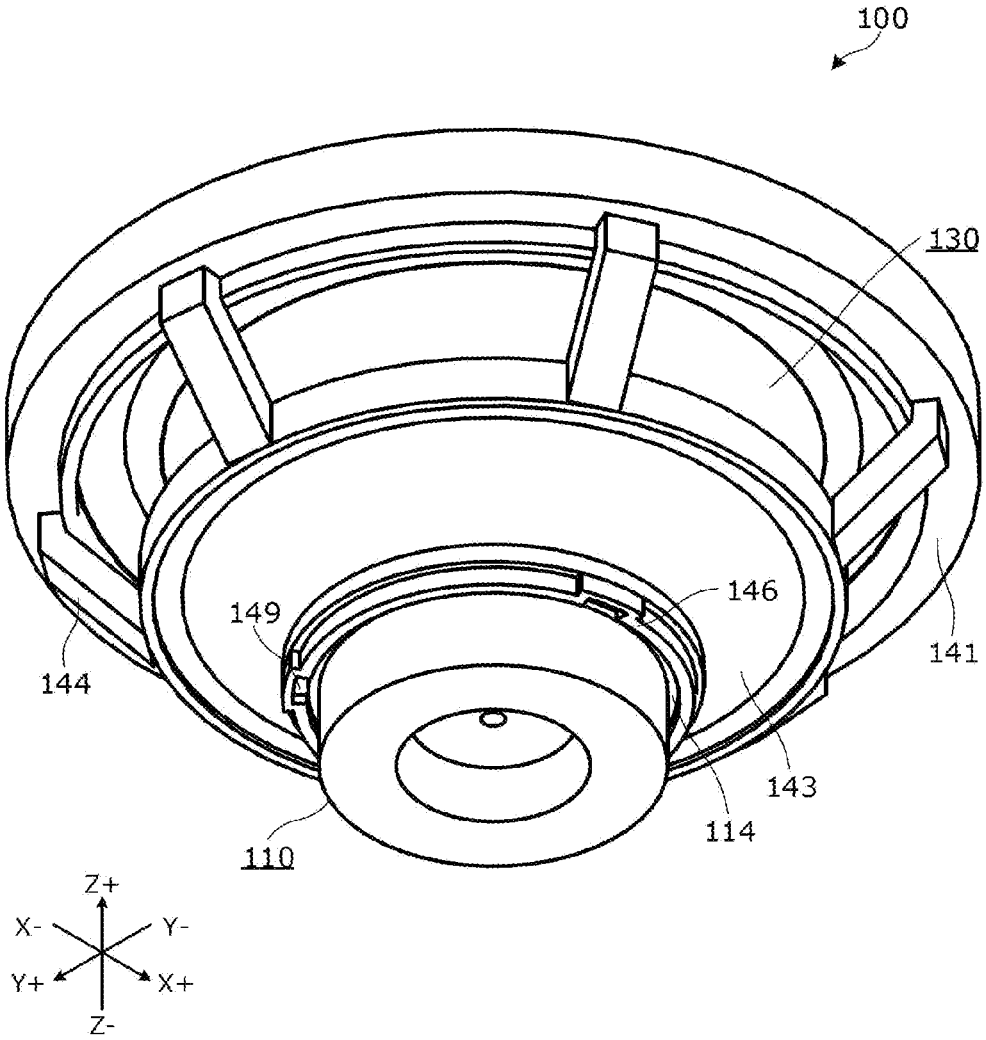
FIG. 2 is a back perspective view of the external appearance of the loudspeaker device according to the present embodiment.
Figure 3:
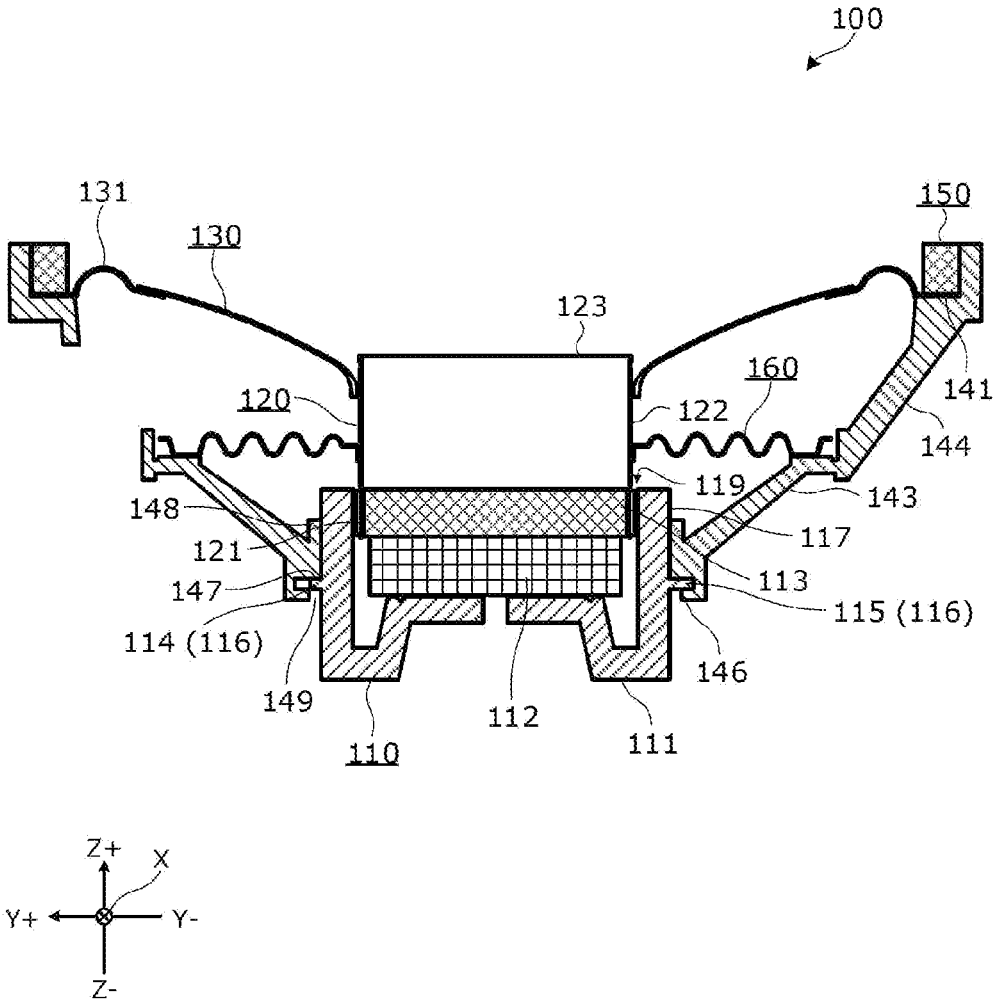
FIG. 3 is a cross-sectional view of the loudspeaker device according to the present embodiment.

FIG. 1 is a front perspective view of an external appearance of a loudspeaker device according to the present embodiment. FIG. 2 is a back perspective view of the external appearance of the loudspeaker device according to the present embodiment. FIG. 3 is a cross-sectional view of the loudspeaker device according to the present embodiment. As illustrated in these figures, loudspeaker device 100 is an electroacoustic transducer that converts an electric signal into sound. Loudspeaker device 100 includes magnetic circuit 110, voice coil body 120, diaphragm 130, and frame 140.

Magnetic circuit 110 is a circuit that generates a steady magnetic field in magnetic gap 119 (see FIG. 3). In the present embodiment, magnetic circuit 110 is of an inner magnet type. Magnetic circuit 110 includes yoke 111 having a cylindrical shape with a bottom, magnet 112 having a disc shape and placed in yoke 111, and top plate 113 having a disc shape and attached to an end surface of magnet 112 that is opposite to the end surface of magnet 112 that is in contact with yoke 111. Top plate 113 defines magnetic gap 119 between yoke 111 and top plate 113.

Voice coil body 120 includes voice coil 121 that generates a magnetic field according to an input signal, and bobbin 122 that has a cylindrical shape and around which voice coil 121 is wound.

Diaphragm 130 is attached to the outer periphery of a distal end portion of bobbin 122 of voice coil body 120. Voice coil 121 is placed around a proximal end portion of bobbin 122. Cap 123 is attached to the distal end of bobbin 122 to close an opening of bobbin 122. Voice coil 121 is inserted into magnetic gap 119 having a circular ring shape and formed by magnetic circuit 110.

Diaphragm 130 is a membrane-like component that generates sound by being vibrated by reciprocating motion of voice coil body 120 in the winding axis direction of voice coil body 120. Diaphragm 130 may have any shape (structure). In the present embodiment, diaphragm 130 has a shape of a truncated cone (a shape derived by cutting the apex of a cone). Moreover, diaphragm 130 includes edge 131 in the outer peripheral portion of diaphragm 130. Edge 131 has an annular bulge shape. A through hole is provided in the center of diaphragm 130. Diaphragm 130 is adhered to the outer peripheral surface of bobbin 122 with voice coil body 120 being inserted into the though hole.

In the present embodiment, the entire outer peripheral portion of diaphragm 130 is adhered to first annular portion 141 of frame 140. In order to improve the strength of attachment, the entire outer peripheral portion of diaphragm 130 is attached to first annular portion 141 with the entire outer peripheral portion of diaphragm 130 being sandwiched between first annular portion 141 and holding component 150. Holding component 150 is a component having an annular shape and having approximately the same level of mechanical strength as the mechanical strength of frame 140.

Frame 140 is what is called a base component that forms the structural basis of loudspeaker device 100, and holds at least yoke 111 of magnetic circuit 110 and diaphragm 130. Frame 140 may have any shape. In the present embodiment, frame 140 includes:

through hole portion 143 having a shape of a shallow hollow truncated cone that supports magnetic circuit 110 with magnetic circuit 110 being inserted into through hole portion 143; first annular portion 141 having a circular ring shape and to which the outer peripheral portion of diaphragm 130 is directly connected and adhered; and connecting portion 144 that has a pillar shape and connects through hole portion 143 and first annular portion 141. A plurality of connecting portions 144 are arranged along a circumference about the winding axis of voice coil body 120.

The material of frame 140 may be any material. In the present embodiment, frame 140 includes a resin. Through hole portion 143, first annular portion 141, and connecting portion 144 are integrally formed.

Damper 160 (see FIG. 3) is a component that connects frame 140 and voice coil body 120, and supports reciprocating motion of voice coil body 120 in the tube axis direction of voice coil body 120. In the present embodiment, damper 160 is a thin circular ring component having a ripple shape, and the inner periphery of damper 160 is attached to a middle portion of voice coil body 120 and the outer periphery of damper 160 is attached to a middle portion of frame 140. Note that there may be cases where loudspeaker device 100 does not include damper 160.

Figure 4:
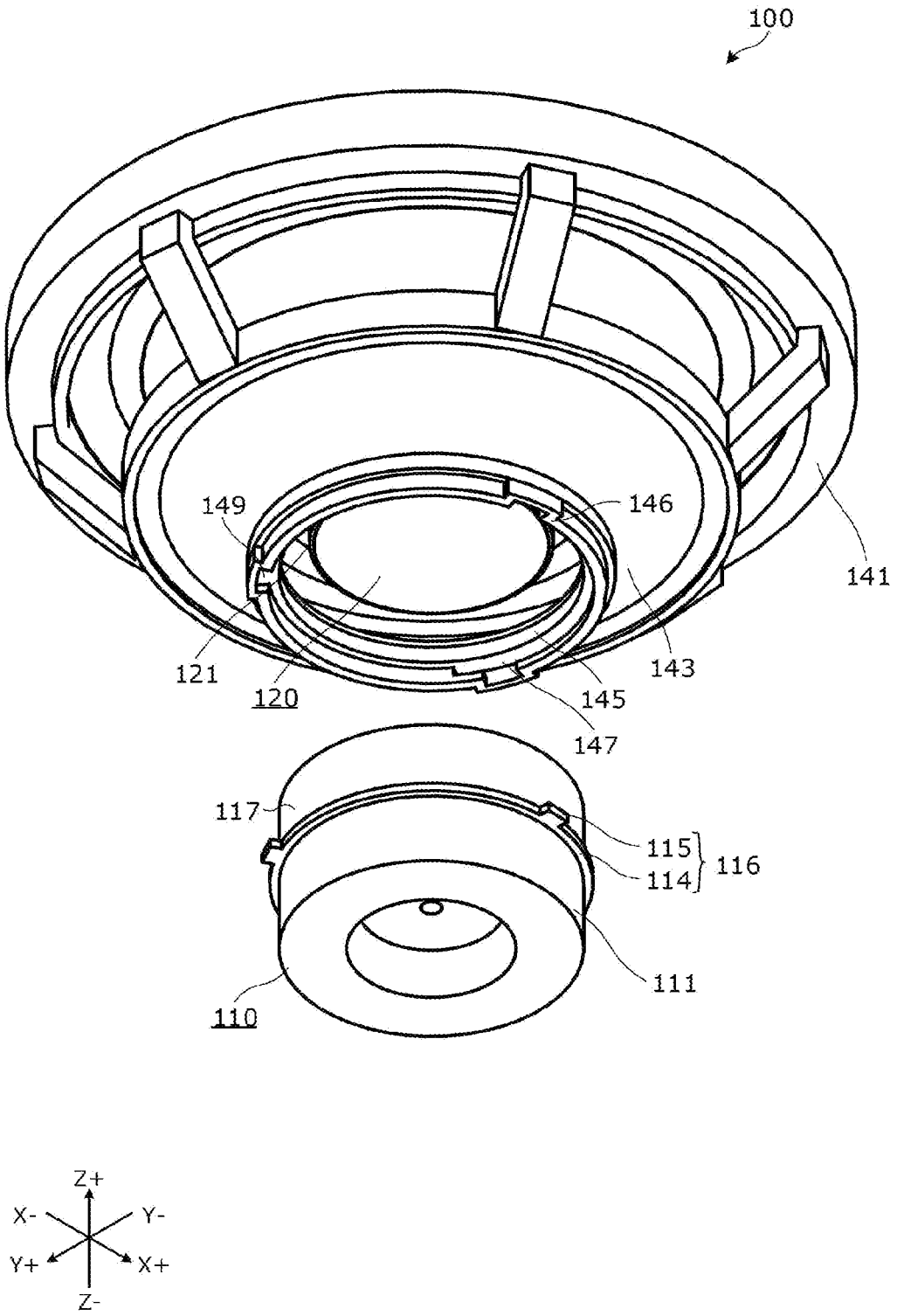
FIG. 4 is an exploded perspective view of the loudspeaker device according to the present embodiment from which a magnetic circuit is taken out from a frame.

FIG. 4 is an exploded perspective view of the loudspeaker device according to the present embodiment from which the magnetic circuit is taken out from the frame. Through hole 145 is provided in a top portion of through hole portion 143 of frame 140 and holds yoke 111 at a predetermined position with yoke 111 being inserted into through hole 145. Through hole 145 is provided in through hole portion 143 such that the tube axis of the through hole 145 matches the winding axis of voice coil body 120. Outer peripheral surface portion 147 (see FIG. 3) that is an outer end surface of a portion of frame 140 that forms through hole 145 is in a plane perpendicular to the winding axis of voice coil body 120. Frame 140 includes extension portion 148 (see FIG. 3) having a circular ring shape, and extending and protruding inward at a location opposite to outer peripheral surface portion 147 in the tube axis direction of through hole 145. This makes it possible to reduce the thickness of through hole portion 143 and increase the length of through hole 145, and effectively suppress the tilting of yoke 111 to be inserted into through hole 145, with respect to the tube axis of through hole 145.

Yoke 111 included in magnetic circuit 110 includes protrusion portion 116 and insertion portion 117. Protrusion portion 116 abuts outer peripheral surface portion 147 defining through hole 145 having a cylindrical shape with magnetic gap 119 being inside frame 140, i.e., in a state in which top plate 113, which is another component that defines magnetic gap 119, is placed in through hole portion 143 of frame 140. Insertion portion 117 is inserted into through hole 145.

Protrusion portion 116 may have any shape. For example, protrusion portion 116 may be a protrusion that protrudes in a radial direction, or a flange having a circular ring shape. In the present embodiment, protrusion portion 116 includes: flange 114 that protrudes in a circular ring shape from the outer peripheral surface of yoke 111; and engaging protrusion 115 that protrudes in a radial direction from the outer peripheral surface of flange 114. The surface of flange 114 and the surface of engaging protrusion 115 that face frame 140 are flush with each other, and are in a plane perpendicular to the tube axis of yoke 111.

The diameter of through hole 145 and the diameter of the outer peripheral surface of insertion portion 117 of yoke 111 may be in a relation that forms a gap having a length that does not adversary affect sound pressure frequency characteristics of loudspeaker device 100. It should be noted that this relation may be an interference fit. In other words, insertion portion 117 of yoke 111 may be pressed to fit into through hole 145.

In the present embodiment, frame 140 includes engagement portion 146 near outer peripheral surface portion 147. Engagement portion 146 is engaged with engaging protrusion 115 of protrusion portion 116 to structurally fix yoke 111 to frame 140. Engaging protrusion 115 of protrusion portion 116 and engagement portion 146 may be engaged with each other in any manner. In the present embodiment, engagement portion 146 is provided to face outer peripheral surface portion 147 with a distance that allows engaging protrusion 115 to be inserted between engagement portion 146 and outer peripheral surface portion 147. Moreover, frame 140 includes passing through portion 149 that allows engaging protrusion 115 to pass therethrough when yoke 111 is inserted into through hole 145. The gap between engagement portion 146 and outer peripheral surface portion 147 communicates with passing through portion 149. With such an engaging structure, yoke 111 is inserted into through hole 145 with engaging protrusion 115 being in an orientation that allows engaging protrusion 115 to pass through passing through portion 149, and yoke 111 is rotated such that engaging protrusion 115 is inserted into the gap between engagement portion 146 and outer peripheral surface portion 147 when protrusion portion 116 abuts outer peripheral surface portion 147. With this, engaging protrusion 115 engages with engagement portion 146, and yoke 111 is fixed to frame 140. It should be noted that in the present embodiment, yoke 111 and frame 140 are adhered to each other using an adhesive agent to improve the bonding strength between yoke 111 and frame 140.

As described above, with loudspeaker device 100 according to the present embodiment, the positional relation between yoke 111 and frame 140 is determined by abutting the inner peripheral surface defining through hole 145 provided in frame 140 and the outer peripheral surface of insertion portion 117 of yoke 111 over a long distance in the tube axis direction, and around the entire periphery of yoke 111, instead of determining the positional relation between yoke 111 and frame 140 by engagement of engaging protrusion 115 with engagement portion 146. Therefore, it is possible to suppress displacement between the central axis of yoke 111 and the central axis of frame 140 and suppress a tilt between the central axis of frame 140 and the tube axis of yoke 111, during assembly of loudspeaker device 100. Moreover, a high alignment accuracy can be achieved even in assembling a plurality of loudspeaker devices 100, and the quality of loudspeaker devices 100 can be stabilized.

Moreover, it is possible to increase the dissipation efficiency of heat generated by voice coil 121 by using a structure in which insertion portion 117 of yoke 111 is elongated, magnetic gap 119 is formed inside the body of frame 140 (part other than extension portion 148), and magnetic gap 119 is not covered with the body of frame 140. It should be noted that although extension portion 148 partially covers magnetic gap 119, extension portion 148 is a thin annular part that protrudes inward from the body of frame 140, and therefore the effect on the heat dissipation efficiency is limited.

Note that the present disclosure should not be limited to the above embodiment. For example, another embodiment achieved by arbitrarily combining structural components or excluding some structural components described in this description may be included as an embodiment of the present disclosure. Furthermore, variations obtained by various modifications to the foregoing embodiment that can be conceived by a person having ordinary skill in the art, that are within the scope of the essence of the present disclosure, that is, the intended meanings of the recitations of the claims, are also included in the present disclosure.

For example, frame 140 does not have to include engagement portion 146 that structurally fixes yoke 111. Yoke 111 may be fixed to frame 140 by being adhered thereto.

Figure 5:
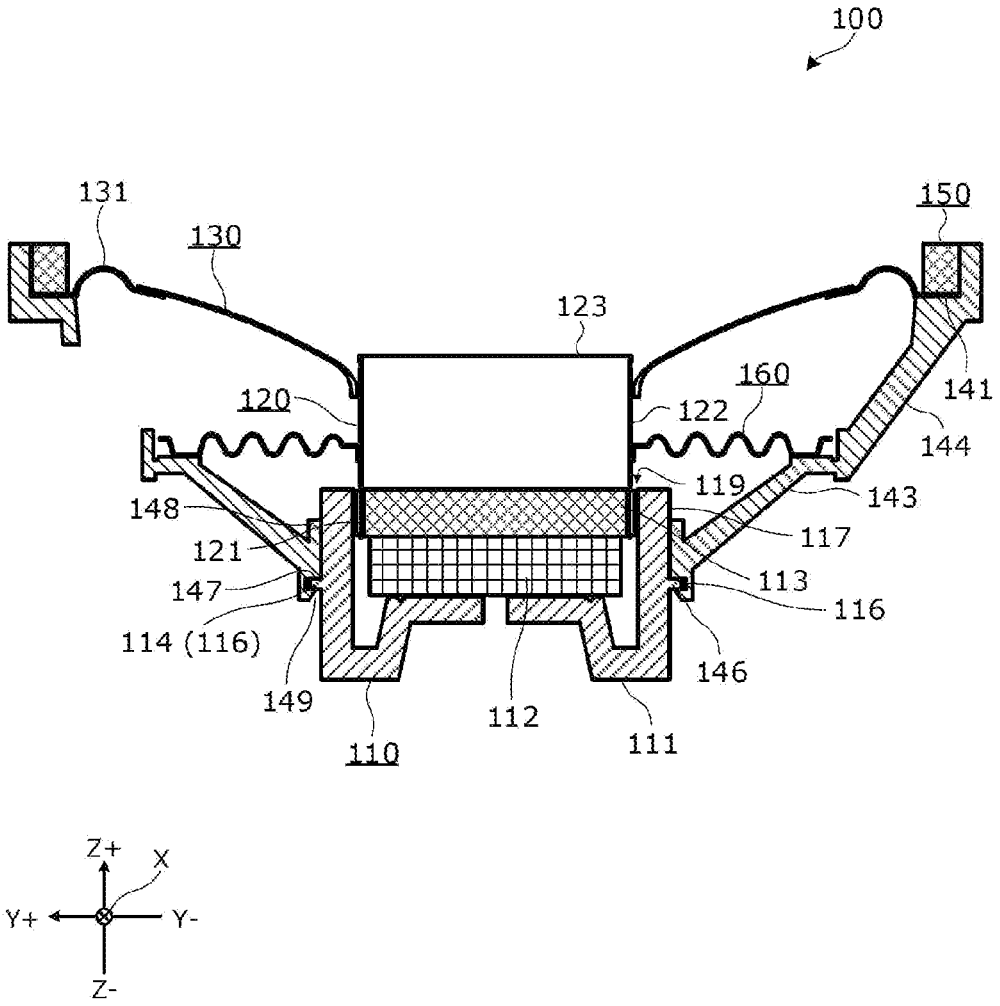
FIG. 5 is a cross-sectional view of the loudspeaker device according to another aspect of the present disclosure.

Moreover, protrusion portion 116 may be engaged with engagement portion 146 not only by rotating yoke 111 with respect to frame 140, but also by pressing yoke 111 into frame 140 to engage protrusion portion 116 with engagement portion 146. As a specific example, as illustrated in FIG. 5, engagement portion 146 includes a tapered surface that abuts protrusion portion 116 when yoke 111 is inserted into through hole 145. Protrusion portion 116 has a circular ring flange-like shape that does not include engaging protrusion 115. With such a structure, engagement portion 146 is bent such that engagement portion 146 goes outward by the tapered surface subject to the pressing force from protrusion portion 116 when yoke 111 is inserted into through hole 145. This allows protrusion portion 116 to pass through engagement portion 146. After protrusion portion 116 passes through engagement portion 146, engagement portion 146 returns to the original position and protrusion portion 116 engages with engagement portion 146. Accordingly, yoke 111 is structurally fixed to frame 140.

Moreover, loudspeaker device 100 may be a loudspeaker device 100 what is called a coaxial loudspeaker device including, in front of diaphragm 130, a second loudspeaker device that outputs a high frequency range.

Moreover, a physical equalizer, such as a resonator, may be included in front of diaphragm 130.

Moreover, loudspeaker device 100 may include a cabinet, and may be attached to a structure, for example, a casing of an electronic device, such as a television and a computer, or a movable body, such as a vehicle and an airplane. Moreover, loudspeaker device 100 may be attached to a casing included in headphones or an in-ear earphone.

While an embodiment has been described herein above, it is to be appreciated that various changes in form and detail may be made without departing from the spirit and scope of the present disclosure as presently or hereafter claimed.

Further Information about Technical Background to this Application

The disclosure of the following patent application including specification, drawings and claims is incorporated herein by reference in their entirety: Japanese Patent Application No. 2021-053421 filed on Mar. 26, 2021.

INDUSTRIAL APPLICABILITY

The present disclosure is applicable to a loudspeaker device that reproduces an audio signal, such as music, as sound.

The invention claimed is:

1. A loudspeaker device comprising:

a magnetic circuit that includes a yoke having a cylindrical shape with a bottom; a magnet; and a top plate;

a voice coil body including one end portion inserted into a magnetic gap between the yoke and the top plate;

a diaphragm connected to another end portion of the voice coil body; and a frame that holds the yoke and the diaphragm, wherein the frame includes a through hole that holds the yoke at a predetermined position with the yoke being inserted into the through hole, the yoke includes a protrusion portion that abuts an outer peripheral surface portion of the frame that defines the through hole, with the magnetic gap being inside the frame, the frame includes an engagement portion that is engaged with the protrusion portion of the yoke to fix the yoke, the yoke is held in the frame with the yoke protruding inside the frame, the protrusion portion is closer to a center of the yoke than to both end surfaces of the yoke in a tube axis direction of the yoke, and the protrusion portion of the yoke includes a flange protruding in a circular ring shape from an outer peripheral surface of the yoke, and an engaging protrusion that protrudes in a radial direction from an outer peripheral surface of the flange.

2. The loudspeaker device according to claim 1, wherein the engagement portion includes a tapered surface that abuts the protrusion portion when the yoke is inserted into the through hole.

3. The loudspeaker device according to claim 1, wherein a surface of the flange and a surface of engaging protrusion that face the frame are flush with each other, and are in a plane perpendicular to the tube axis of the yoke.

* * * * *